United States Patent [19]

Wheeler

[11] 4,031,785

[45] June 28, 1977

[54] SQUEEZE ACTUATED WRENCH

[76] Inventor: Charles J. Wheeler, 2346 Haines, Madison, Ohio 44057

[22] Filed: Sept. 2, 1975

[21] Appl. No.: 609,399

[52] U.S. Cl. ..... 81/57.39

[51] Int. Cl.[2] ..... B25B 13/46

[58] Field of Search ..... 81/57.39, 60, 57.46, 81/58.1

[56] References Cited

UNITED STATES PATENTS

| | | | |
|---|---|---|---|
| 1,543,338 | 6/1925 | Neal et al. | 81/58.1 |
| 3,270,596 | 9/1966 | Hall et al. | 81/57.39 |
| 3,941,017 | 3/1976 | Lenker et al. | 81/57.39 |

FOREIGN PATENTS OR APPLICATIONS

| | | | |
|---|---|---|---|
| 850,357 | 9/1970 | Canada | 81/57.39 |

*Primary Examiner*—James L. Jones, Jr.

[57] ABSTRACT

A squeeze actuated wrench includes a body, a rotatable socket supported at one end of the body, a driver member for effecting rotation of the socket and a handle adapted to be gripped by the user's hand and rotated relative to the body to actuate the driver member and effect rotation of the socket. One end of the driver member engages the outer peripheral surface of the socket member and defines a first pivot point about which the driver member pivots upon rotation of the socket. The opposite end of the driver member engages the handle and defines a second pivot point about which the handle and driver member rotate relative to each other upon actuation of the driver member and rotation of the socket. The handle is pivotably supported by the body at a third pivot point. A longitudinal axis is defined between the third pivot point and the axis of rotation of the socket member. The first pivot point is located on one side of the longitudinal axis and the second pivot point is located on the opposite side of the longitudinal axis. The first pivot point is adapted to move away from the longitudinal axis and the second pivot point is adapted to move toward the longitudinal axis upon actuation of the driver and rotation of the socket. This arrangement provides a compact squeeze actuated wrench with great mechanical advantage developed by the lever arrangement between the handle and the socket.

13 Claims, 6 Drawing Figures

SQUEEZE ACTUATED WRENCH

BACKGROUND OF THE INVENTION

The present invention relates to a squeeze actuated wrench and more specifically to a compact squeeze actuated ratchet wrench with a lever arrangement having a high mechanical advantage for the transfer of forces between the handle and the rotatable socket.

Numerous attempts have been made to develop a compact ratchet wrench with a high degree of mechanical advantage. Such attempts are exemplified by the Lachance U.S. Pat. No. 3,447,404, the Gregory U.S. Pat. No. 3,616,714 and the Williams U.S. Pat. No. 3,726,161. While both Gregory and Williams disclose a squeeze actuated ratchet wrench, the lever design is such as to cause inefficiency with a resultant decrease in mechanical advantage. For example, both Gregory and Williams utilize a sliding cam action for effecting rotation of the socket. The mechanical losses associated with a sliding cam action due to the friction losses at the cam surface are such as to decrease the efficiency of the wrench. Moreover, wrenches such as disclosed in Lachance, which are not squeeze actuated, are not as versatile or maneuverable as desired.

Another area of inefficiency exhibited in the prior art is the location of the driver member relative to the outer periphery of the socket. It should be appreciated that the torque transmitted from the driver to effect rotation of the socket is dependent upon the force transmitted by the driver and the angle at which the driver engages with the toothed outer periphery of the socket. For maximum efficiency the driver should be disposed 90° from a radius of the socket and the closer to 90°, the higher the mechanical efficiency. Since the prior art does not closely approach a 90° angle between the driver and the socket, the efficiency of the prior art devices is not maximized. It should be appreciated that the teeth of the driver means of the prior art such as is exemplified by Williams, Gregory or Lachance engage a plurality of the teeth on the outer periphery of the socket means. Obviously, by engaging a plurality of teeth, the force is spread out around the perimeter of the socket means and does not closely approach the 90° optimum angle.

SUMMARY OF THE INVENTION

The present invention relates to a compact squeeze actuated wrench which includes a toggle type linkage for maximizing the mechanical efficiency of the squeeze actuated ratchet wrench.

In accordance with the present invention a squeeze actuated ratchet wrench is provided. The squeeze actuated ratchet wrench includes a rotatable socket means having an annular toothed outer peripheral surface and a driver member having one end thereof for engaging with the toothed peripheral surface and cooperating therewith to define a first pivot point about which the driver pivots relative to the socket means upon actuation of the driver and rotation of the socket means. A body is provided for supporting the socket means at one end portion thereof and includes a handle portion at the opposite end thereof. An actuating handle for actuating the driver is provided having one end thereof adapted to be gripped by a user's hand and the other end thereof engaging with the opposite end of the driver member and defining a second pivot point about which the actuating handle and the driver member rotate relative to each other upon actuation of the driver and rotation of the socket means. The actuating handle is pivotably connected to the body at a third pivot point which is disposed intermediate the end portions of the actuating handle. The longitudinal axis for the wrench passes through the third pivot point and the axis of rotation of the socket means with the first pivot point being located on one side of the longitudinal axis and the second pivot point being located on the opposite side of the longitudinal axis. The handle portion of the body and the actuating handle are adapted to be held simultaneously in the hand of the user and squeezed relative to each other to rotate the one end of the actuating handle toward the body to actuate the driver and effect rotation of the socket means.

The present invention further provides a squeeze actuated ratchet wrench as set forth in the next preceeding paragraph wherein the first pivot point moves away from the longitudinal axis and the second pivot point moves toward the longitudinal axis upon rotation of the one end of the actuating handle toward the body to effect actuation of the driver and rotation of the socket means.

Another provision of the present invention is to provide a squeeze actuated ratchet wrench as set forth in the next preceeding paragraph wherein the opposite end of the actuating handle includes a concave surface portion and the opposite end of the driver member includes a convex surface portion which engages with the concave surface portion to define the second pivot point. The concave and convex surface portions are configured in such a way that the distance between the second pivot point and the third pivot point decreases to increase the mechanical efficiency of the wrench upon rotation of the actuating handle toward the body.

DESCRIPTIONS OF THE DRAWINGS

FIGS. **4*a* and 4*b*** are enlarged sectional views of the pivot point between the driver member and actuating handle in non-actuated and actuated conditions, respectively.

Figure 5:
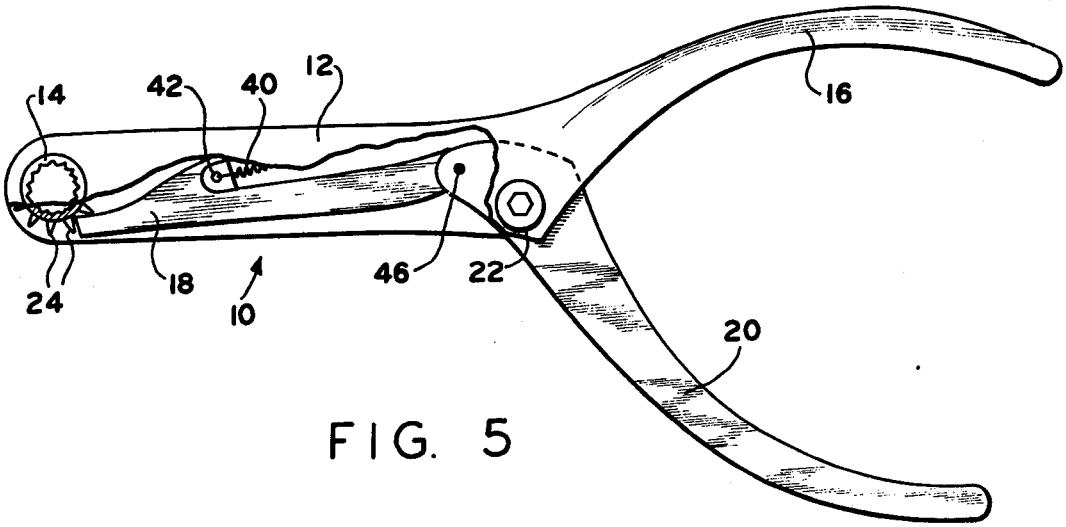

FIG. 5 is a side view of another embodiment of the present invention.

DESCRIPTION OF THE PREFERRED EMBODIMENT

Figure 2:
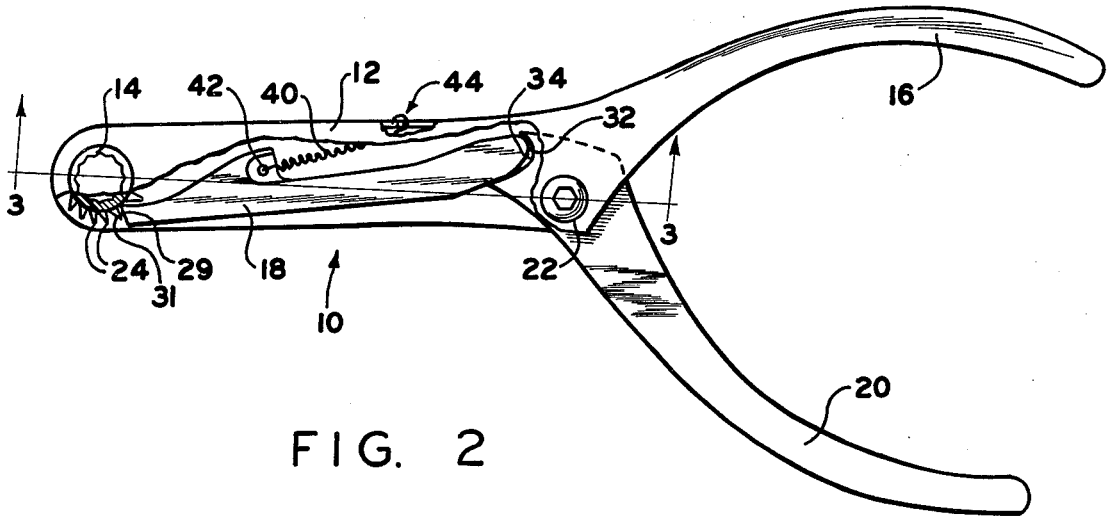
FIG. 2 is a top view of the ratchet wrench in an unactuated condition.
Figure 1:
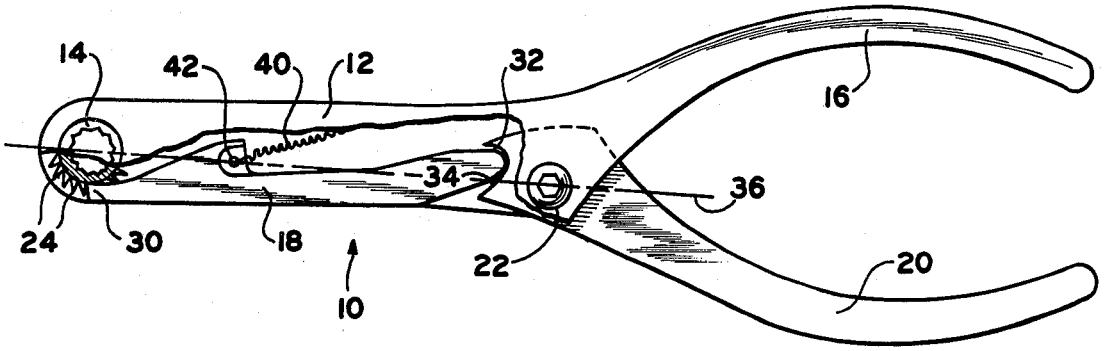
FIG. 1 is a top view of the ratchet wrench in an actuated condition.
Figure 3:
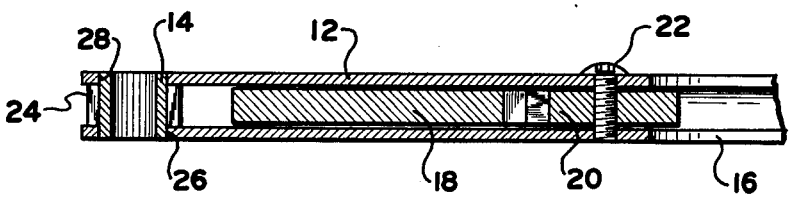
FIG. 3 is a cross sectional view taken approximately along the lines 3—3 of FIG. 2.
Figure 4A:
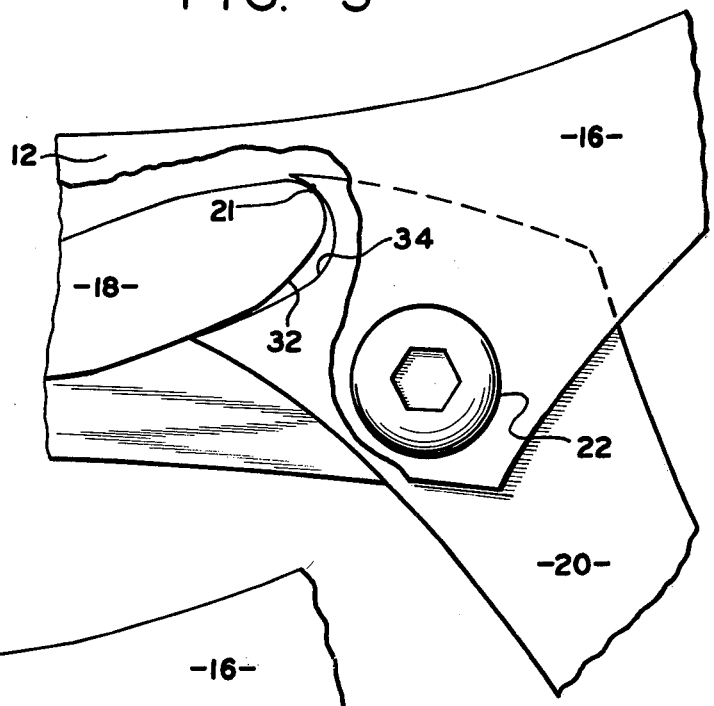
Figure 4B:
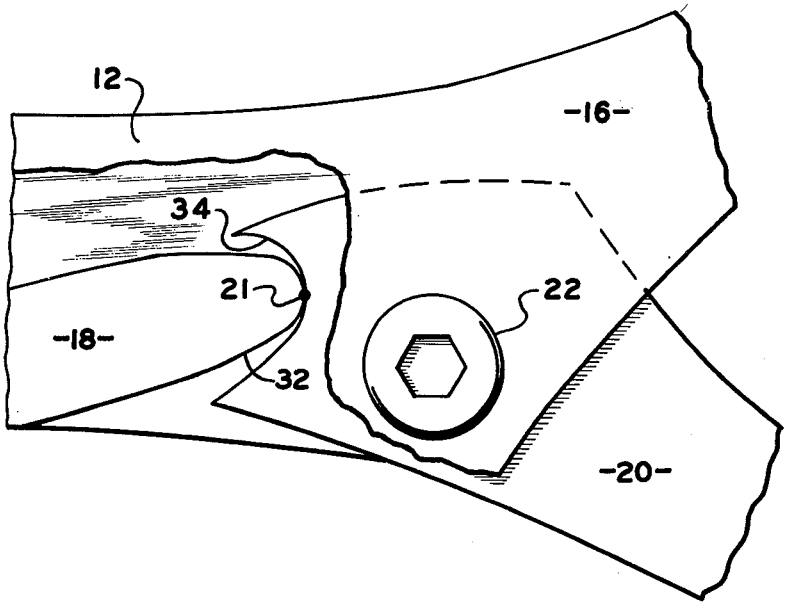

Referring to the figures and more specifically to FIGS. 1 and 2 a squeeze actuated ratchet wrench 10 is disclosed. The squeeze actuated ratchet wrench 10 includes a body 12 having a rotatable socket 14 disposed at one end thereof and a handle portion 16 disposed at the opposite end thereof. A driver member 18 is provided for effecting rotation of the socket member 14 when the driver moves from the position shown in FIG. 2 to its position shown in FIG. 1. To this end, a feed or actuating handle 20 is pivotably connected to the body 12 by a pivot pin 22. The actuating handle 20 engages with the driver 18 to effect movement of the driver 18 and rotation of the socket 14 upon rotation of the actuating handle 20 toward the handle portion 16 of the body 12.

As disclosed in FIGS. 1 and 2 a return spring 40 is provided to return the driver 18 and handle 20 from their actuated positions illustrated in FIG. 1 to their unactuated conditions illustrated in FIG. 2 upon release of the handle 20 by a user. The spring 40 is attached at one end thereof to the driver 18 at the point 42 and at the opposite end thereof at the point 44 to the body 12. When the driver and handle are located in their positions shown in FIG. 1, the return spring 40 exerts a biasing force on the driver 18 which tends to move the driver 18 upwardly and to the right from the position illustrated in FIG. 1. The biasing force exerted by the spring 40 on the driver 18 is transferred to the surface 34 of the handle 20 to bias the handle 20 in a clockwise direction to thereby return the handle 20 and driver 18 to their unactuated positions as illustrated in FIG. 2 when the handle 20 is released by the user.

The socket includes a toothed outer periphery which includes a plurality of radial extending teeth 24 and a pair of necked down annular portions 26. The annular portions 26 extend through openings 28 disposed in the side walls of the body 12 and support the socket 14 for rotation in the body 12. The teeth 24 disposed on the socket 14 extend in a substantially radial direction from the axis of rotation of the socket 14 to enable the driver 18 to exert a tangential force relative to the socket 14 on the teeth 24 to effect rotation of the socket 14. The substantially radial extention of the teeth 24 relative to the socket 14 enables the driver 18 to exert a force on the surface 29 of the tooth 24 with which it engages. The surface 29 is disposed substantially coextensive with the radius extending from the axis of rotation of the socket 14 and the driver 18 engages the surface 29 to exert a force substantially perpendicular to the radius on the surface 29. This, of course, maximizes the forces transferred by the driver 18 to the socket 14 due to the fact that the torque exerted on the teeth 24 equals the force exerted by the driver 18 on the teeth 24 times the distance the force is applied from the axis of rotation of the socket 14 times the sine of the angle between the radius and the direction in which the force is applied to the teeth 24 ($T=F \times d=FdSin\ \theta$). Thus, it should be appreciated that the torque exerted on the socket 14 by the driver 18 depends on the magnitude of the force, on the direction at which the driver 18 applies the force to the socket 14, and also on the point of application of the force to the socket 14 relative to the axis of rotation of the socket 14. If the angle between the radius of the socket 14 and the direction in which the driver 18 applies the force is equal to 90° then the force transferred between the driver 18 and socket 14 is maximized.

The driver 18 is operable to engage with the surface 29 of one tooth 24 on the outer periphery of the socket 14. To this end the driver 18 includes a toothed end portion 30 which is operable to engage with only one tooth at a time on the outer periphery of the socket 14. By engaging with only one tooth at a time the angle at which the force is directed by the driver 18 to the teeth 24 is maintained as near as possible to 90° relative to the teeth 24. This of course maximized the torque exerted on the socket 14 by the driver 18. It should be appreciated that movement of the driver 18 from its nonactuated position of FIG. 2 to its actuated condition of FIG. 1 is accomplished by a rocking and sliding movement of the driver 18 downwardly and to the left as viewed in the Figures. The rocking linear movement help to insure that the driver maintains good contact with the tooth 24 engaged therewith as the socket 14 rotates under the force of the driver 18. Each time the actuating handle 20 is squeezed the driver 18 will engage with one tooth 24 and effect rotation of the socket 14. When the handle 20 is released the driver 18 will move to the right as viewed in the Figures to engage with the next sequential tooth on the outer periphery of the socket 14. Thus, each time the driver 18 is moved from its position in FIG. 2 to its position shown in FIG. 1 the socket 14 will rotate about an angle equal to 360° divided by the number of teeth 24.

Movement of the driver 18 from its position shown in FIG. 2 to its position shown in FIG. 1 is effected by the user of the tool 10 squeezing the handles 20 and 16 relative to each other. This effects rotation of the actuating handle 20 toward the handle 16 which effects movement of the driver 18. The driver 18 includes a convex surface portion 32 at one end portion thereof. The actuating handle 20 includes a concave surface portion 34 at one end thereof within which the convex surface portion 32 of the driver 18 is nestled. Rotation of the handle 20 in a counterclockwise direction to the position illustrated in FIG. 1 causes the concave surface portion 34 to rotate about the pivot point 22 and thus move closer to the socket 14. This causes the driver 18 to rock and move linearly toward the left as viewed in FIG. 1. Since the end 30 of the driver 18 engages one of the teeth 24 of the socket 14, when the driver 18 moves to the left the socket 14 will be rotated thereby by an amount equal to 360° divided by the number of teeth 24 disposed on the socket 14.

The concave surface portion 34 of the handle 20 cooperates with the convex surface portion 32 of the driver 18 to define a pivot point 21 at which the surface 32 engages with the surface 34 and about which the handle 20 pivots relative to the driver 18 upon rotation of the socket 14. The configuration of the surfaces 32 and 34 is such as to enable the surfaces 32, 34 to contact along a line which defines the pivot point 21 and which moves toward the pivot point 22 upon rotation of the handle 20 in a counterclockwise direction. Movement of the pivot point 21 toward the pivot point 22 upon rotation of the handle 20 increases the mechanical advantage of the linkage assembly due to the decrease in the length of the lever arm between the movable pivot point 21 and fixed pivot point 22. Thus, if a constant force were exerted to effect rotation of the handle 20 about the pivot point 22, the force transferred to the driver 18 would increase as the distance between the pivot point 21 and the pivot point 22 decreases. Accordingly, as the handle 20 is squeezed the force exerted by the driver 18 on the socket 14 will increase, assuming a constant force on handle 20.

In order to more fully define the lever arrangement which results in a high degree of mechanical advantage the point at which the end 30 of the driver 18 engages the surface 29 of the teeth 24 will be defined as a first pivot point 31. It should be apparent that as the driver 18 effects rotation of the socket 14, the toothed end 30 of the driver will rotate about the pivot point 31 relative to the surface 29 of the tooth 24 as the socket 14 rotates. Moreover, as the socket 14 rotates the pivot point 31 will move in a downwardly direction as viewed in FIGS. 1 and 2. The pivot point 21 between the concave and convex surface portions 34 and 32, respectively, can be defined as a second pivot point which also moves in a downwardly direction as viewed in FIG. 1 when the socket 14 is rotated. A third, fixed pivot point is defined by the pivot point 22 which supports the handle 20 for rotation relative to the body 12. A longitudinal axis 36 for the tool 10 is defined as passing through the fixed pivot point 22 and the axis of rotation of the socket member 14. It can be seen that the first pivot point 31 defined between the teeth 24 and the driver 18, is located on one side of the longitudinal axis 36 (below as viewed in FIG. 1) while the second pivot point 21 defined by the engagement of the handle 20 and the driver 18 is located on the opposite side (above as viewed in FIG. 1) of the longitudinal axis 36. Rotation of the handle 20 in a counterclockwise direction will cause the first pivot point to move downwardly away from the longitudinal axis 36 as the socket 14 rotates and the second pivot point will move downwardly toward the longitudinal axis 36. This provides a lever arrangement which is extremely efficient in transferring forces from the handle 20 to effect rotation of the socket 14.

A further embodiment of the present invention is illustrated in FIG. 5 which discloses a squeeze actuated socket ratchet wrench similar to the squeeze actuated socket wrench illustrated in FIGS. 1–4 and like numerals will indicate like parts. The difference between the ratchet wrench illustrated in FIGS. 1–4 and that illustrated in FIG. 5 is that the second pivot point 21 where the driver 18 engages the handle 20 is a fixed pivot point. To this end a pivot pin 46 is provided which passes through an opening disposed in the driver 18 and in the handle 20 to pivotably connect the driver 18 and handle 20 for relative rotation. The operation of the squeeze actuated ratchet wrench disclosed in FIG. 5 is analogous to the operation of the ratchet wrench disclosed in FIGS. 1–4 with the exception that the second pivot point 21 does not move toward the third pivot point 22 where the pin 22 supports the handle 20 for rotation relative to the body 12. However, the location of the first and second pivot points in FIG. 5 are still on opposite sides of the longitudinal axis 36 and still provides the same degree of mechanical efficiency.

While the present invention has been described as a squeeze actuated socket wrench, it should be apparent that rather than a socket being located at the end of the body 12 other suitable tools could also be utilized. For example, a rotatable screwdriver or allen wrench could also be provided. Moreover, it should be appreciated that the present structure provides a squeeze actuated socket wrench wherein a high degree of mechanical efficiency is present. The mechanical efficiency is due to the lever arrangement wherein the pivot points are located on opposite sides of the longitudinal axis of the tool and the relationship between the driver and the toothed outer periphery with the socket wherein the driver only engages one tooth at a time and approaches maintaining a 90° angle between the driver and the tooth with which the driver is engaged.

From the foregoing it should be apparent that a new and improved squeeze actuated ratchet wrench has been provided which includes a rotatable socket having a annular toothed outer peripheral surface and a driver member having one end thereof for engaging with the toothed peripheral surface and defining a first pivot point about which the driver pivots relative to the socket upon rotation of the socket. The squeeze actuated ratchet wrench as described includes a body for supporting the socket and an actuating handle pivotably connected to the body about a third pivot point. The driver member and the actuating handle cooperate to define a second pivot point about which each rotates relative to the other upon actuation of the ratchet wrench. A longitudinal axis is defined which passes through the third pivot point and the axis of rotation of the socket means and the first pivot point is located on one side of the longitudinal axis and the second pivot point is located on the opposite side of the longitudinal axis to provide a lever arrangement for the socket wrench which exhibits a high degree of mechanical efficiency.

I claim:

1. A squeeze actuated ratchet wrench comprising a rotatable socket means having an annular toothed outer peripheral surface, a driver member having one end thereof engaging with said toothed peripheral surface of said socket means and defining a first pivot point about which said driver member pivots relative to said socket means upon rotation of said socket means by said driver member and an opposite end, a body for supporting said socket means at one end portion thereof for rotation about an axis of rotation and having a handle portion at the opposite end thereof, an actuating handle having one end thereof adapted to be gripped by the user's hand and the other end thereof engaging with said opposite end of said driver member and defining a second pivot point about which said actuating handle and said driver member rotate relative to each other upon rotation of said socket means, said actuating handle being pivotably connected intermediate said end portions of said actuating handle to said body at a third pivot point for rotation relative to said body, said third pivot point and the axis of rotation of said socket means defining a path through which a longitudinal axis of the wrench passes with said first pivot point being located on one side of said longitudinal axis and said second pivot point being located on the opposite side of said longitudinal axis, said actuating handle and said handle portion of said body being adapted to be simultaneously gripped by the hand of the user and squeezed to rotate said one end of said actuating handle toward said body to rock and move said driver toward said socket means and effect rotation of said socket means and wherein the distance between said third pivot point and said second pivot point decreases upon movement of said one end of said actuating handle toward said body to increase the force transferable between said actuating handle and said driver member by increasing the mechanical advantage of the lever arrangement defined by said actuating handle and said driver member.

2. A squeeze actuated ratchet wrench as defined in claim 1 wherein said first pivot point moves away from said longitudinal axis and said second pivot point moves toward said longitudinal axis upon rotation of said one end of said actuating handle towards said body upon actuation of said driver and rotation of said socket means.

3. A squeeze actuated wrench as defined in claim 1 wherein said other end of said actuating handle includes a concave surface portion and said opposite end of said driver member includes a convex surface portion which engages and is nestled in said concave surface portion of said actuating handle, said concave surface portion including a pair of said portions extending around said convex surface portion for restraining and preventing movement of said convex surface portion out of said nestled relationship with said concave surface portion, the contacting portions of said concave and convex surface portions defining said second pivot point.

4. A squeeze actuated ratchet wrench as defined in claim 1 further including spring means disposed between said driver and said body means for biasing said driver member toward an unactuated position.

5. A squeeze actuated ratchet wrench as defined in claim 1 wherein said one end of said driver member is operable to engage with only one tooth at a time on said toothed outer peripheral surface of said socket means.

6. A squeeze actuated ratchet wrench as defined in claim 2 further including spring means disposed between said driver and said body means for biasing said driver member toward an unactuated position.

7. A squeeze actuated ratchet wrench as defined in claim 6 wherein said one end of said driver member is operable to engage with only one tooth at a time on said toothed outer peripheral surface of said socket means.

8. A squeeze actuated wrench as defined in claim 7 wherein said other end of said actuating handle includes a concave surface portion and said opposite end of said driver member includes a convex surface portion which engages and is nestled in said concave surface portion of said actuating handle, said concave surface portion including a pair of side portions extending around said convex surface portion for restraining and preventing movement of said convex surface portion out of said nestled relationship with said concave surface portion, the contacting portions of said concave and convex surface portions defining said second pivot point.

9. A squeeze actuated ratchet wrench as defined in claim 5 wherein said teeth disposed on the outer peripheral surface of said socket means includes a driver engaging surface thereon disposed substantially radially of said socket means, said driver engaging surface being engageable with said one end of said driver member with said driver member being substantially perpendicular to said driver engaging surface when engaged therewith.

10. A squeeze actuated ratchet wrench as defined in claim 9 wherein said driver member is operable when actuated to rock and move linearly toward said socket member to maintain full contact with the driver member and the tooth engaged therewith upon rotation of the socket member in response to actuation of the driver member.

11. A squeeze actuated ratchet wrench comprising a rotatable socket means having an annular toothed outer peripheral surface, a driver member having a first end engaging with said toothed peripheral surface of said socket means for effecting rotation of said socket means and a second end, a body for supporting said socket means for rotation and including a handle portion, an actuating handle having a first end thereof adapted to be gripped by a user's hand and a second end thereof engaging with the second end of said driver member and defining a movable first pivot point about which said actuating handle and said driver member rotate relative to each other upon rotation of said socket means, said actuating handle being pivotably connected intermediate said first and second ends thereof to said body at a second pivot point for rotation relative to said body, said actuating handle and said driver member cooperating to define a lever assembly for rotating said socket means, said actuating handle and said handle portion of said body being adapted to be simultaneously gripped by the hand of a user and squeezed to rotate said actuating handle toward said body to effect movement of said driver member and rotation of said socket means, said actuating handle and said driver member having a configuration which enables said first pivot point to move toward said second pivot point to increase the mechanical efficiency of the lever assembly when said actuating handle is rotated toward said body by a user's hand.

12. A squeeze actuated ratchet wrench as defined in claim 11 wherein said second end of said actuating handle includes a concave surface portion and said second end of said driver member includes a convex surface portion which engages and is nestled in said second concave surface portion of said actuating handle, the contacting portions of said concave and convex surface portions defining said first pivot point.

13. A squeeze actuated ratchet wrench as defined in claim 12 wherein said first end of said driver member is operable to engage with only one tooth at a time on said toothed outer peripheral surface of said socket means.

* * * * *